US008779688B2

(12) United States Patent
Tseng

(10) Patent No.: US 8,779,688 B2
(45) Date of Patent: Jul. 15, 2014

(54) LIGHT EMITTING DIODE DRIVING CIRCUIT

(75) Inventor: Kuan-Jen Tseng, Sinshih Township (TW)

(73) Assignee: Himax Analogic, Inc., Tainan County (TW)

( * ) Notice: Subject to any disclaimer, the term of this patent is extended or adjusted under 35 U.S.C. 154(b) by 790 days.

(21) Appl. No.: 12/911,084

(22) Filed: Oct. 25, 2010

(65) Prior Publication Data

US 2012/0098456 A1 Apr. 26, 2012

(51) Int. Cl.
*H05B 37/00* (2006.01)

(52) U.S. Cl.
USPC ..... 315/307; 315/318; 315/320; 345/102; 345/82; 345/212

(58) Field of Classification Search
USPC ..... 315/185 S, 224, 247, 291, 307–326; 345/82–92, 102, 204, 211, 214
See application file for complete search history.

(56) References Cited

U.S. PATENT DOCUMENTS

| | | | | |
|---|---|---|---|---|
| 8,378,586 | B2 * | 2/2013 | Peker et al. | 315/291 |
| 2007/0188426 | A1 * | 8/2007 | Ito et al. | 345/82 |
| 2010/0102734 | A1 | 4/2010 | Quick et al. | |

FOREIGN PATENT DOCUMENTS

| | | | |
|---|---|---|---|
| JP | 2006-269393 | A | 10/2006 |
| TW | 200820178 | A | 5/2008 |
| TW | 201034502 | A1 | 9/2010 |

OTHER PUBLICATIONS

English translation of abstract of TW 200820178 A (published May 1, 2008).
English translation of abstract of TW 201034502 A1 (published Sep. 16, 2010).
English translation of abstract of JP 2006-269393 A (published Oct. 5, 2006).

* cited by examiner

*Primary Examiner* — Douglas W Owens
*Assistant Examiner* — Borna Alaeddini
(74) *Attorney, Agent, or Firm* — McClure, Qualey & Rodack, LLP

(57) ABSTRACT

A light emitting diode driving circuit includes connected driving units, each of which is configured for driving multiple channels of light emitting diodes generating a feedback voltage for the corresponding driving unit. Each of the driving units includes a selection circuit for comparing the feedback voltage with an input voltage to output a smaller one of the feedback voltage and the input voltage to a next one of the driving units, as the input voltage for the next one of the driving units.

11 Claims, 2 Drawing Sheets

LIGHT EMITTING DIODE DRIVING CIRCUIT

BACKGROUND

1. Technical Field

The present disclosure relates to a driving circuit. More particularly, the present disclosure relates to a light emitting diode driving circuit.

2. Description of Related Art

For a conventional light emitting diode (LED) driving integrated circuit (IC), it usually drives 4 to 8 channels of LEDs at most. However, there is a need to adopt multiple LED driving ICs connected in parallel to drive more channels of LEDs for bigger-sized panels and various applications.

In the LED driving IC, a feedback voltage is usually adopted and transmitted back to the LED driving IC from the LEDs, and is used as a reference for boosting the LED driving IC. Hence there is a need to decide a common reference for boosting the multiple LED driving ICs.

SUMMARY

In accordance with one embodiment of the present invention, a light emitting diode driving circuit including a plurality of connected driving units each for driving multiple channels of light emitting diodes generating a feedback voltage is provided. Each of the driving units includes a first comparator, a first output switch and a second output switch. The first comparator includes a first input to couple to the feedback voltage and a second input to operatively couple to an input voltage or a power voltage. The first output switch is configured for receiving the feedback voltage and enabled by an output of the first comparator when the voltage at the first input is smaller than the voltage at the second input, to output the feedback voltage to a next one of the driving units, as the input voltage for the next one of the driving units. The second output switch is configured for operatively receiving the input voltage and enabled by the output of the first comparator when the voltage at the first input is larger than the voltage at the second input, to output the input voltage to the next one of the driving units, as the input voltage for the next one of the driving units.

In accordance with another embodiment of the present invention, a light emitting diode driving circuit is provided. The light emitting diode driving circuit includes a plurality of connected driving units each for driving multiple channels of light emitting diodes generating a feedback voltage. Each of the driving units includes a selection circuit for comparing the feedback voltage with an input voltage to output a smaller one of the feedback voltage and the input voltage to a next one of the driving units, as the input voltage for the next one of the driving units. A minimum one of the sequentially compared feedback voltages corresponding to the driving units is obtained for boosting the driving units.

In accordance with yet another embodiment of the present invention, a light emitting diode driving circuit is provided. The light emitting diode driving circuit includes a plurality of connected driving units each for driving multiple channels of light emitting diodes generating a feedback voltage for the corresponding driving unit. Each of the driving units includes a first comparator for operatively comparing a power voltage or an input voltage generated by comparing the feedback voltages with one another for the previous driving units, with the feedback voltage for the present driving unit, so as to output a smaller one of the feedback voltage and the input voltage or a smaller one of the feedback voltage and the power voltage to a next one of the driving units, as the input voltage for the next one of the driving units.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiments, with reference to the accompanying drawings as follows.

DESCRIPTION OF THE EMBODIMENTS

In the following description, several specific details are presented to provide a thorough understanding of the embodiments of the present invention. One skilled in the relevant art will recognize, however, that the present invention can be practiced without one or more of the specific details, or in combination with or with other components, etc. In other instances, well-known implementations or operations are not shown or described in detail to avoid obscuring aspects of various embodiments of the present invention.

The terms used in this specification generally have their ordinary meanings in the art and in the specific context where each term is used. The use of examples anywhere in this specification, including examples of any terms discussed herein, is illustrative only, and in no way limits the scope and meaning of the invention or of any exemplified term. Likewise, the present invention is not limited to various embodiments given in this specification.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present invention. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

Figure 1:
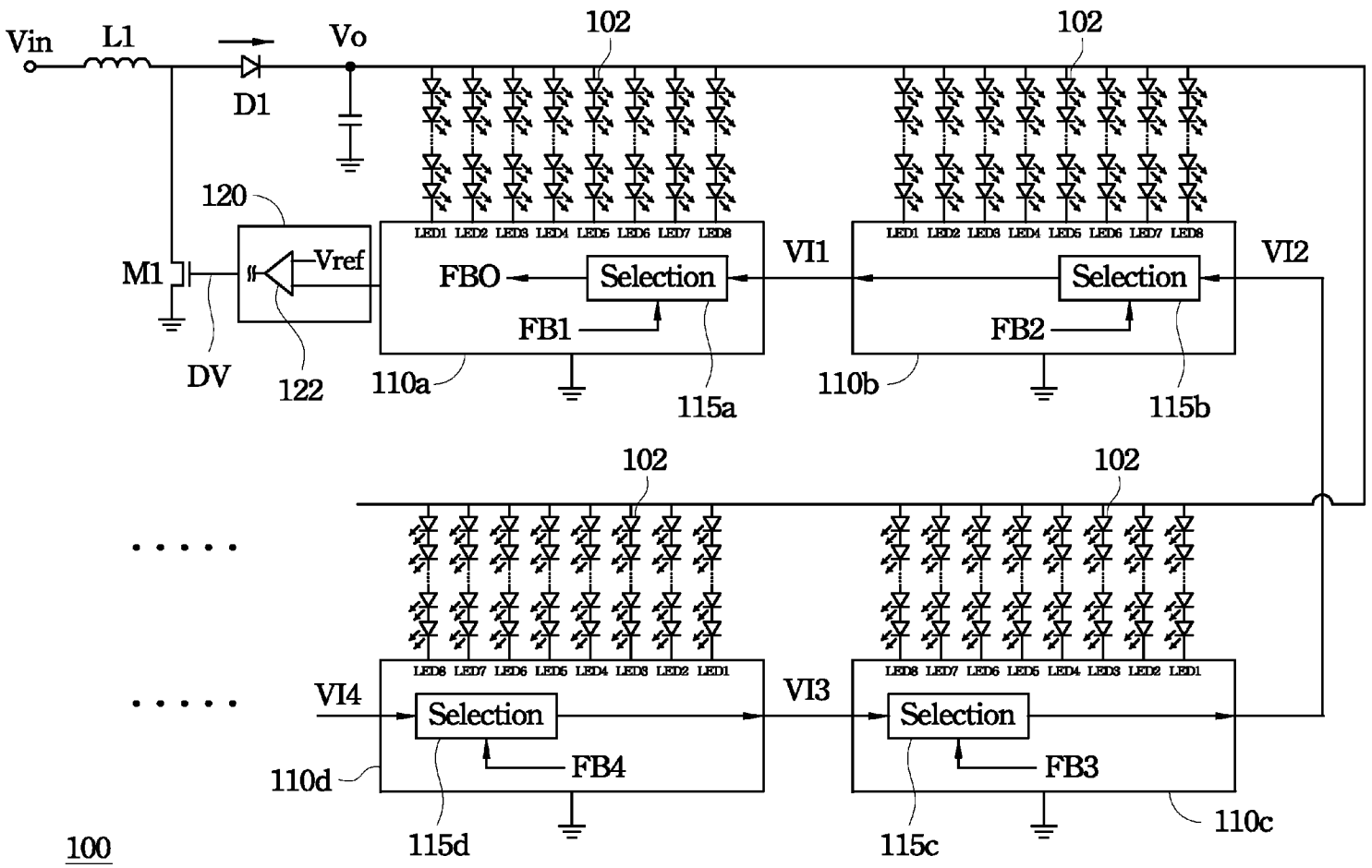
FIG. 1 is a diagram of a light emitting diode driving circuit in accordance with one embodiment of the present invention.

FIG. 1 is a diagram of a light emitting diode (LED) driving circuit in accordance with one embodiment of the present invention. The LED driving circuit 100 is configured for driving multiple channels of LEDs 102 and includes a plurality of driving units 110 (e.g. $1^{st}$ driving unit 110*a*, $2^{nd}$ driving unit 110*b*, $3^{rd}$ driving unit 110*c*, $4^{th}$ driving unit 110*d* . . . , etc.) connected in parallel or in series. Each of driving units 110 is connected to several channels of LEDs 102 (e.g. 8 channels) to further drive the LEDs 102. In practice, the LED driving circuit 100 can be implemented by a driving integrated circuit (IC), and each of the driving units 110 can be implemented by a current sink circuit in the driving IC.

As shown in FIG. 1, when each of the driving units 110 drives the LEDs 102, the LEDs 102 on the channels generate operation voltages respectively, and a minimum one of the operation voltages corresponding to respective channels is selected to be a feedback voltage FB for the corresponding driving unit 110 in order to boost the corresponding driving unit 110. For example, in the $4^{th}$ driving unit 110*d*, the operation voltages corresponding to respective channels of LEDs 102 are compared with each other in order to generate the feedback voltage FB4 for boosting the $4^{th}$ driving unit 110*d* to drive the LEDs 102. Similarly, in the $3^{rd}$ driving unit 110*c*, the operation voltages corresponding to respective channels of LEDs 102 are compared with each other in order to generate the feedback voltage FB3 for boosting the $3^{rd}$ driving unit 110*c* to drive the LEDs 102; and so on.

Each of the driving units 110 further includes a selection circuit 115 which compares the feedback voltage FB with an input voltage VI to output a smaller one of the voltages FB and VI to a next one of the driving units 110, as the input voltage VI for the next one of the driving units 110. For example, in the $3^{rd}$ driving unit 110*c*, the selection circuit 115*c* compares the feedback voltage FB3 with the input voltage VI3 and then outputs a smaller one of them to the $2^{nd}$ driving unit 110*b*, to be the input voltage VI2 for the $2^{nd}$ driving unit 110*b*. Similarly, in the $2^{nd}$ driving unit 110*b*, the selection circuit 115*b* compares the feedback voltage FB2 with the input voltage VI2 and then outputs a smaller one of them to the $1^{st}$ driving unit 110*a*, to be the input voltage VI1 for the $1^{st}$ driving unit 110*a*.

In the embodiments of the present invention, for improving the efficiencies of the connected driving units 110, the feedback voltages FB for the driving units 110 are sequentially compared with one another such that a minimum one of the feedback voltages, i.e. voltage FBO, is obtained. For example, the voltage VI3 is compared with the feedback voltage FB3 for the $3^{rd}$ driving unit 110*c* such that a smaller one of the two voltages is obtained and outputted as the input voltage VI2 for the $2^{nd}$ driving unit 110*b*; the voltage VI2 is compared with the feedback voltage FB2 for the $2^{nd}$ driving unit 110*b* such that a smaller one of the two voltages is obtained and outputted as the input voltage VI1 for the $1^{st}$ driving unit 110*a*; and then the voltage VI1 is compared with the feedback voltage FB1 for the $1^{st}$ driving unit 110*a* such that a smaller one of the two voltages is obtained and outputted as the voltage FBO.

The LED driving circuit 100 may further include a boost controller 120 for receiving the minimum one of the feedback voltages, FBO, and outputting a gate driving voltage DV for controlling a switch M1 in accordance with the voltage FBO, such that the switch M1 turns on or off according to the gate driving voltage DV, and an input voltage Vin received by the LED driving circuit 100 can thus be converted to a boost voltage Vo for boosting the driving units 110*a*, 110*b*, 110*c*, 110*d*, . . . , etc. and all of the LEDs 102 can be driven as well.

In the present embodiment, the boost controller 120 may further include a comparator 122 for receiving a reference voltage Vref and the minimum one of the feedback voltages, FBO. The comparator 122 compares the reference voltage Vref with the voltage FBO such that the gate driving voltage DV can be outputted in accordance with the comparison result.

In addition, if the input voltage VI for the present driving unit 110 is smaller than a reference voltage (e.g. 0.3 V), which is possible when some of the LEDs 102 fail or when there is no previous driving unit 110, the present driving unit 110 may output the feedback voltage FB as the input voltage VI for a next driving unit 110 by comparing the feedback voltage FB with a power voltage VDD larger than the feedback voltage FB. For example, when there is no previous driving unit before the $4^{th}$ driving unit 110*d* so that the input voltage VI4 inputted into the $4^{th}$ driving unit 110*d* is smaller than the reference voltage (e.g. 0.3 V), the $4^{th}$ driving unit 110*d* may output the feedback voltage FB4 as the input voltage VI3 for the $3^{rd}$ driving unit 110*c*.

Figure 2:
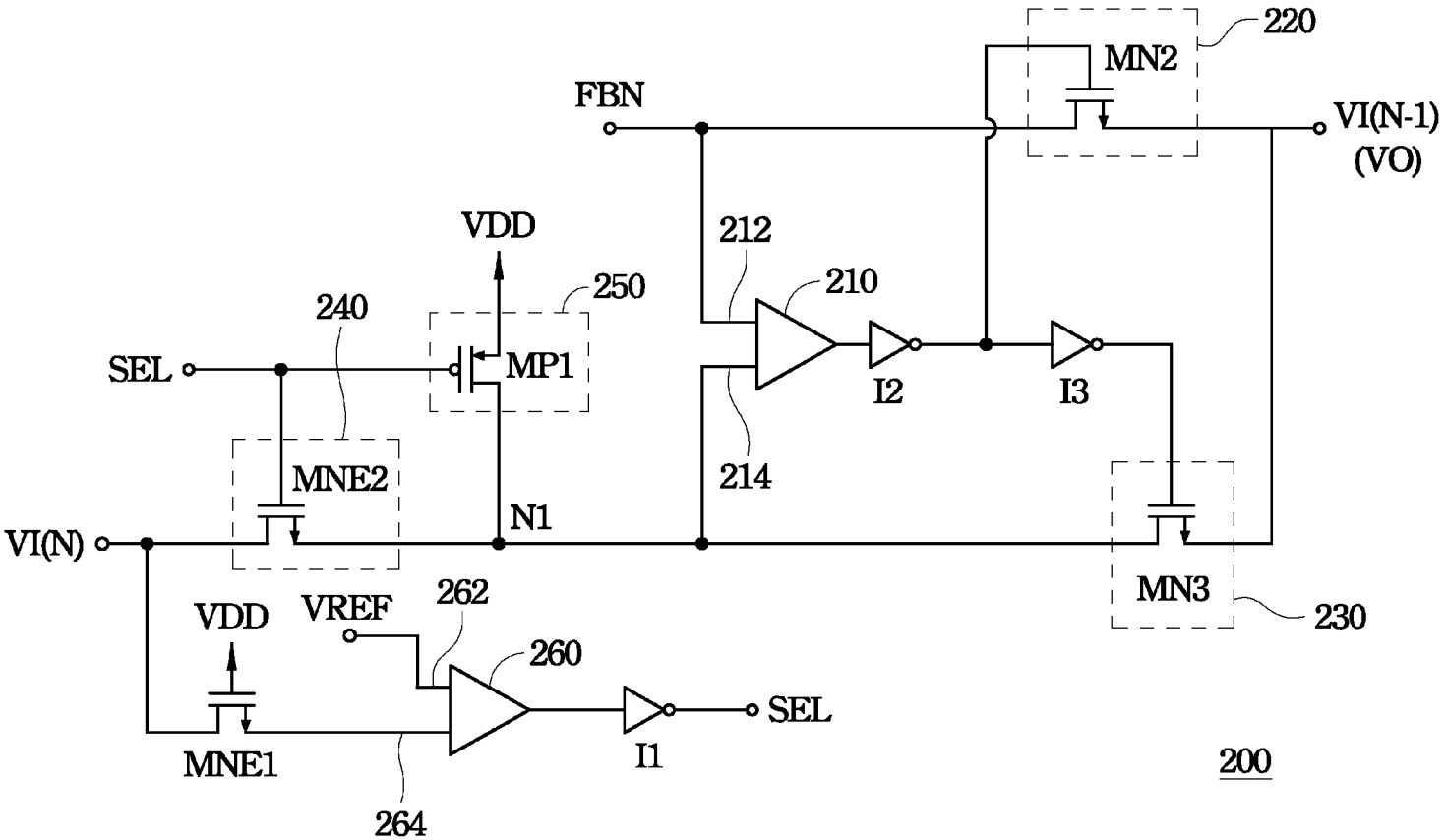
FIG. 2 is a diagram of a selection circuit in each of the driving units shown in FIG. 1, in accordance with one embodiment of the present invention.

FIG. 2 is a diagram of the selection circuit in each of the driving units shown in FIG. 1, in accordance with one embodiment of the present invention. Hereinafter, the present driving unit is referred to as the $N^{th}$ driving unit, the previous driving unit is referred to as the $(N+1)^{th}$ driving unit, and the next driving unit is referred to as the $(N-1)^{th}$ driving unit, based on the sequence of voltage comparison shown in FIG. 1. The selection circuit 200 compares the feedback voltage FBN for the present driving unit (e.g. the $N^{th}$ driving unit), with the input voltage VIN from a previous driving unit (e.g. the $(N+1)^{th}$ driving unit), to output a smaller one between the feedback voltage FBN and the input voltage VIN to a next driving unit (e.g. the $(N-1)^{th}$ driving unit), as the output voltage VO of the present driving unit and the input voltage VI(N−1) for the next driving unit.

The selection circuit 200 includes a first comparator 210, a first output switch 220 and a second output switch 230. The first comparator 210 includes a first input 212 to couple to the feedback voltage FB and a second input 214 to operatively couple to the input voltage VI or the power voltage VDD. The first output switch 220 receives the feedback voltage FB and enabled by an output of the first comparator 210, for example through an inverter I2, when the voltage at the first input 212 is smaller than the voltage at the second input 214, to output the feedback voltage FB to the next driving unit 110, as the input voltage VI for the next driving unit 110. The second output switch 230 operatively receives the input voltage VI and enabled by the output of the first comparator 210, for example through the inverter I2 and an inverter I3, when the voltage at the first input 212 is larger than the voltage at the second input 214, to output the input voltage VI to the next driving unit 110, as the input voltage for the next driving unit 110.

In the present embodiment, the first output switch 220 includes an N-type MOS transistor MN2 controlled through the inverter I2 by the output of the first comparator 210, and the second output switch 230 includes an N-type MOS transistor MN3 controlled through the inverters I2 and I3 by the output of the first comparator 210.

The selection circuit 200 may further include a selection switch 240 and a pull-up switch 250. The selection switch 240 is coupled between the second input 214 of the first comparator 210 and the input voltage VI and enabled such that the second input 214 of the first comparator 210 receives the input voltage VI. The pull-up switch 250 is coupled between the second input 214 of the first comparator 210 and the power voltage VDD which is larger than the feedback voltage FB, and enabled such that the second input 214 of the first comparator 210 is pulled up to the power voltage VDD.

In the present embodiment, the selection switch 240 includes an N-type MOS transistor MNE2 controlled by a selection signal SEL, and the pull-up switch 250 includes a P-type MOS transistor MP1 controlled by selection signal SEL as well.

The selection circuit 200 may further include a second comparator 260. The second comparator 260 includes a third input 262 to couple to a reference voltage VREF and a fourth input 264 to couple, for example through an electrostatic discharge (ESD) device MNE1, to the input voltage VI. The output of the second comparator 260 is coupled, for example through an inverter I1, to the selection switch 240 and the pull-up switch 250. In the present embodiment, the second comparator 260 generates the selection signal SEL to enable the selection switch 240 when the input voltage VI is larger than the reference voltage VREF, and generates the selection signal SEL to enable the pull-up switch 250 when the input voltage VI is smaller than the reference voltage VREF.

In operation, when the input voltage VI from a previous driving unit 110 is received, the second comparator 260 compares the input voltage VI with the reference voltage VREF (e.g. 0.3 V). In the present embodiment, when the input voltage VI is larger than the reference voltage VREF, for example, due to the normal operation of the LEDs 102 or the condition with input voltage VI, the second comparator 260 outputs the selection signal SEL with logic high level through the inverter I1, so as to enable the selection switch 240 and disable the pull-up switch 250. Then, the input voltage VI is transmitted to the first comparator 210.

After that, the first comparator 210 compares the input voltage VI with the feedback voltage FB. When the feedback voltage FB is smaller than the input voltage VI, the first comparator 210 output a logic signal with logic low level, which becomes at logic high level after the inverter I2, to enable the first output switch 220, and becomes at logic low level after the inverters I2 and I3, to disable the second output switch 230, such that the feedback voltage FB is outputted through the first output switch 220 to be the output voltage VO and the input voltage VI for the next driving unit 110. On the other hand, when the feedback voltage FB is larger than the input voltage VI, the first comparator 210 output an inverting logic signal with logic high level, which becomes at logic low level after the inverter I2, to disable the first output switch 220, and becomes at logic high level after the inverters I2 and I3, to enable the second output switch 230, such that the input voltage VI is outputted through the second output switch 230 to be the output voltage VO and the input voltage VI for the next driving unit 110.

In addition, when the input voltage VI is smaller than the reference voltage VREF (e.g. 0.3 V), for example, due to the failure of the LEDs 102 or the condition without input voltage VI, the second comparator 260 outputs the selection signal SEL with logic low level through the inverter I1, so as to disable the selection switch 240 and enable the pull-up switch 250. Then, the power voltage VDD is transmitted to the first comparator 210 (i.e. the second input of the first comparator 210 is pulled up to the power voltage VDD).

After that, the first comparator 210 compares the power voltage VDD with the feedback voltage FB. Since the feedback voltage FB is smaller than the power voltage VDD, the first comparator 210 output the logic signal with logic low level so as to enable the first output switch 220 and to disable the second output switch 230, such that the feedback voltage FB is outputted to be the output voltage VO and the input voltage VI for the next driving unit 110.

Thus, according to the operation mentioned above, the selection circuit 200 in each of the driving units 110 basically compares the input voltage VI generated by comparing the feedback voltages FB with one another for the previous driving units 110, with the feedback voltage FB for the present driving unit 110, so as to output a smaller one of the feedback voltage FB and the input voltage VI to the next driving unit 110, as the input voltage VI for the next driving unit 110. After the feedback voltages FB for the driving units 110 are sequentially compared with one another, the minimum feedback voltage FB is then fed back to all of the driving units 110, such that the driving units 110 can perform the boost operation based on the minimum feedback voltage FB more efficiently.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded with the broadest interpretation so as to encompass all such modifications and similar structures.

What is claimed is:

1. A light emitting diode driving circuit comprising a plurality of connected driving units, each of the driving units configured for driving multiple channels of light emitting diodes generating a feedback voltage, each of the driving units comprising:

a first comparator comprising a first input to couple to the feedback voltage and a second input for selectively receiving an input voltage and a power voltage;

a pull-up switch coupled between the second input of the first comparator and the power voltage and enabled such that the second input of the first comparator is pulled up to the power voltage;

a second comparator comprising a third input to couple to a reference voltage and a fourth input to couple to the input voltage and generating a selection signal to enable the pull-up switch when the input voltage is smaller than the reference voltage;

a first output switch for receiving the feedback voltage and enabled by an output of the first comparator when the voltage at the first input is smaller than the voltage at the second input, to output the feedback voltage to a next one of the driving units, as the input voltage for the next one of the driving units; and a second output switch for operatively receiving the input voltage and enabled by the output of the first comparator when the voltage at the first input is larger than the voltage at the second input, to output the input voltage to the next one of the driving units, as the input voltage for the next one of the driving units.

2. The light emitting diode driving circuit as claimed in claim 1, wherein each of the driving units further comprises:

a selection switch coupled between the second input of the first comparator and the input voltage and enabled such that the second input of the first comparator receives the input voltage.

3. A light emitting diode driving circuit, comprising:

a plurality of connected driving units, each of the driving units configured for driving multiple channels of light emitting diodes generating a feedback voltage, each of the driving units comprising:

a selection circuit for comparing the feedback voltage with an input voltage to output a smaller one of the feedback voltage and the input voltage to a next one of the driving units, as the input voltage for the next one of the driving units, wherein the selection circuit comprises;

a first comparator for comparing the input voltage with the feedback voltage to output a logic signal when the feedback voltage is smaller than the input voltage and to output an inverting logic signal when the input voltage is smaller than the feedback voltage;

a selection switch for receiving the input voltage and enabled such that the input voltage is transmitted to the first comparator;

a second comparator for comparing the input voltage with a reference voltage, to generate a selection signal to enable a selection switch when the input voltage is larger than the reference voltage and to generate the selection signal to enable the pull-up switch when the input voltage is smaller than the reference voltage; and a pull-up switch for receiving a power voltage larger than the feedback voltage and enabled such that the power voltage is transmitted to the first comparator to be compared with the feedback voltage;

wherein a minimum one of the sequentially compared feedback voltages corresponding to the driving units is obtained for boosting the driving units.

4. The light emitting diode driving circuit as claimed in claim 3, wherein the selection circuit further comprises:

a first output switch for receiving the feedback voltage and enabled by the logic signal to output the feedback voltage to the next one of the driving units.

5. The light emitting diode driving circuit as claimed in claim 3, wherein the selection circuit further comprises:

a second output switch for receiving the input voltage and enabled by the inverting logic signal to output the input voltage to the next one of the driving units.

6. The light emitting diode driving circuit as claimed in claim 3, further comprising:

a boost controller for receiving the minimum one of the sequentially compared feedback voltages and outputting a driving voltage in accordance with the minimum one of the sequentially compared feedback voltages.

7. A light emitting diode driving circuit, comprising:

a plurality of connected driving units, each of the driving units configured for driving multiple channels of light emitting diodes generating a feedback voltage for the corresponding driving unit, each of the driving units comprising:

a first comparator comprising a first input to couple to the feedback voltage and a second input for selectively receiving an input voltage and a power voltage, the first comparator configured for operatively comparing one of the power voltage and the input voltage with the feedback voltage for the present driving unit, so as to output a smaller one of the feedback voltage and the input voltage or a smaller one of the feedback voltage and the power voltage to a next one of the driving units, as the input voltage for the next one of the driving units, wherein the input voltage is generated by comparing the feedback voltages with one another for the previous driving units;

a second comparator for comparing the input voltage with a reference voltage to enable the selection switch when the input voltage is larger than the reference voltage and to enable the pull-up switch when the input voltage is smaller than the reference voltage;

a selection switch coupled between the first comparator and the input voltage and enabled to transmit the input voltage to the first comparator; and a pull-up switch coupled between the first comparator and the power voltage and enabled to transmit the power voltage to the first comparator.

8. The light emitting diode driving circuit as claimed in claim 7, wherein the first comparator outputs a logic signal when the feedback voltage is smaller than the input voltage and outputs an inverting logic signal when the input voltage is smaller than the feedback voltage.

9. The light emitting diode driving circuit as claimed in claim 8, wherein each of the driving units further comprises:

a first output switch for receiving the feedback voltage and enabled by the logic signal to output the feedback voltage to the next one of the driving units; and a second output switch for receiving the input voltage and enabled by the inverting logic signal to output the input voltage to the next one of the driving units.

10. The light emitting diode driving circuit as claimed in claim 7, wherein the power voltage is larger than the feedback voltage, and the first comparator operatively compares the power voltage with the feedback voltage when the pull-up switch is enabled, so as to output the power voltage to the next one of the driving units.

11. The light emitting diode driving circuit as claimed in claim 7, further comprising:

a boost controller for receiving the minimum one of the sequentially compared feedback voltages and outputting a driving voltage in accordance with the minimum one of the sequentially compared feedback voltages.

* * * * *